US007025526B2

(12) United States Patent
Blair

(10) Patent No.: US 7,025,526 B2
(45) Date of Patent: Apr. 11, 2006

(54) PORTABLE TRAFFIC CONTROL DEVICE

(75) Inventor: William H. Blair, Wheeling, WV (US)

(73) Assignee: PMG, Inc., Wheeling, WV (US)

( * ) Notice: Subject to any disclaimer, the term of this patent is extended or adjusted under 35 U.S.C. 154(b) by 0 days.

(21) Appl. No.: 10/799,411

(22) Filed: Mar. 11, 2004

(65) Prior Publication Data

US 2004/0190990 A1 Sep. 30, 2004

Related U.S. Application Data

(60) Provisional application No. 60/453,650, filed on Mar. 11, 2003.

(51) Int. Cl.
*E01F 13/12* (2006.01)
*E01F 13/10* (2006.01)

(52) U.S. Cl. ..... 404/6; 404/9

(58) Field of Classification Search ..... 404/6, 404/9; 256/1

See application file for complete search history.

(56) References Cited

U.S. PATENT DOCUMENTS

| | | | | |
|---|---|---|---|---|
| 922,165 | A * | 5/1909 | Lee | 256/18 |
| 2,762,145 | A | 9/1956 | Rupe | 39/5 |
| 3,652,059 | A | 3/1972 | Groblebe | 256/1 |
| 4,097,170 | A | 6/1978 | Dickinson | 404/6 |
| 4,318,079 | A | 3/1982 | Dickinson | 340/127 |
| 5,498,102 | A | 3/1996 | Bissell | 404/6 |
| 5,588,774 | A | 12/1996 | Behan | 404/6 |
| 5,733,063 | A | 3/1998 | Bailey et al. | 404/6 |
| 5,890,832 | A | 4/1999 | Soleau | 404/6 |
| 6,224,291 | B1 | 5/2001 | Mateychuk | 404/6 |
| 6,322,285 | B1 | 11/2001 | Ben | 404/6 |
| 6,409,418 | B1 | 6/2002 | Blair et al. | 404/6 |
| 6,474,903 | B1 * | 11/2002 | Marts et al. | 404/6 |

FOREIGN PATENT DOCUMENTS

| | | |
|---|---|---|
| FR | 2605655 | 10/1986 |

* cited by examiner

*Primary Examiner*—Raymond W. Addie
(74) *Attorney, Agent, or Firm*—Thompson Hine LLP

(57) ABSTRACT

A portable traffic control device having a housing, two generally parallel and independently rotatable shafts beyond extending the housing length, and a plurality of blades connected to each shaft. Each shaft rotates such that the blades on that shaft either protrude up through openings in the top of the housing or extend horizontally within the housing. When a shaft is rotated such that its blades protrude upward, the blades remain protruding and puncture the tires of vehicles driving over the housing in a first direction. The blades are pushed downward into the housing by contact with tires of vehicles driving over the housing in the opposite direction. Biasing means rotates that shaft pushing the blades up to their protruding position. The device is modular in that two or more devices may be detachably connected in series wherein all of the first shafts and all of the second shafts rotate in unison.

20 Claims, 14 Drawing Sheets

PORTABLE TRAFFIC CONTROL DEVICE

CROSS-REFERENCES TO RELATED APPLICATIONS

This application claims the benefit of U.S. Provisional Application No. 60/453,650, filed Mar. 11, 2003.

BACKGROUND OF INVENTION

1. Technical Field

This invention relates to traffic control devices, and in particular to portable devices for selectively hindering the movement of vehicles in two opposing directions through a control point.

2. Related Art

Regulating the flow of vehicular traffic through particular areas is often required to prevent unauthorized ingress to or egress from restricted areas. For example, access to a toll road or parking lot may be blocked unless and until a payment is made, a ticket is obtained, or proper credentials are displayed. Alternatively, departure from these areas may be blocked unless and until a payment is made or proper credentials are displayed. Law enforcement personnel may also block vehicular access to or through certain areas for specific purposes, such as the establishment of a road block to apprehend a suspect.

All of these methods of traffic control typically involve the use of a physical barrier placed at a certain control point that blocks the flow of traffic through the control point so long as the conditions for access through the control point are not met. For example, a toll booth may be placed along an access ramp leading to a toll road such that anyone desiring access to the toll road must drive up to the toll booth. At the toll booth, a gate arm may block the access ramp until a toll is paid, at which time the gate arm raises and permits access to the toll road.

It is often desirable to use a traffic control device that damages the tires of an unauthorized vehicle as it drives through a control point. U.S. Pat. No. 5,733,063 granted to Bailey et al. discloses an example of one such device. This device has a plurality of rotationally mounted levers extending upwardly from a base housing permanently embedded flush with the road surface. The levers rotate into the base housing below the road surface when contacted by a vehicle tire moving in one direction, thus permitting traffic flow in that direction. When contacted by a vehicle tire moving in the opposite direction, however, the levers rotate a hidden blade upward into the tire. The device is therefore uni-directional, permitting traffic flow in one direction and obstructing traffic flow in the opposite direction. A hydraulic system may additionally be actuated to retract the levers underneath the road surface, thereby permitting traffic flow in both directions. The Bailey device is not designed to allow for the selective obstruction of the flow of traffic. That is, the Bailey device cannot be controlled to dynamically change the direction of allowed traffic flow—it only works for one pre-determined direction. Likewise, the Bailey device cannot allow traffic flow in both directions, nor can it simultaneously prohibit the flow of traffic in both directions. In order to achieve such versatility, two such devices must be installed adjacent to one another, back-to-back, as suggested by Bailey et al. The cost and/or space needed for installing two devices rather than one may make installation of a means for multidirectional traffic control infeasible for certain applications. This device also is designed to be permanently embedded in the roadway. Any modification to such a permanently installed traffic control device, such as a lengthening of the effective area covered by the device, might be time-consuming and cost-prohibitive.

Therefore, there is a need for a multidirectional traffic control device housed in a single unit. There is also a need for a portable traffic control device that is not designed to be permanently embedded within a roadway. Additionally, there is a need for a traffic control device that is easy to use and is modular to permit easy and inexpensive extension of the effective area covered by the device.

SUMMARY OF THE INVENTION

This invention solves the problems encountered with using fixed, uni-directional traffic control devices by providing a portable and modular traffic control device with two opposing rows of retractable blades, each row being retractable independently of the other, and facing in opposite directions for regulating traffic flow in either direction.

An aspect of the invention is a traffic control device, including a housing having a length extending from a first end to a second end, and a width extending from a first side to a second side; a first shaft rotatably connected to the housing and extending from the first end of the housing to the second end of the housing; a second shaft rotatably connected to the housing and extending parallel to the first shaft from the first end of the housing to the second end of the housing; blades connected to the first shaft; blades connected to the second shaft; and a cover defining the top of the housing and having slots through which the blades protrude when the traffic control device is activated.

A feature of the invention is two rows of opposing blades, each row being independently retractable of the other, for regulating traffic flow in either or both of two opposing directions.

Another feature of the invention is a portable and modular housing.

Another feature of the invention is rotatable shafts that are connectable to rotatable shafts in an adjacent housing.

Another feature of the invention is a cover with multiple slots for accommodating a plurality of blades.

An advantage of the invention is that the portable traffic control device can be easily moved to and from various desired locations for regulating traffic flow as needed.

Another advantage of the invention is that the length of a traffic control device can be changed simply by adding or subtracting individual devices.

Yet another advantage of the invention is that a single traffic control device can simultaneously regulate traffic flow from either of two directions.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE PREFERRED EMBODIMENTS

Figure 1:
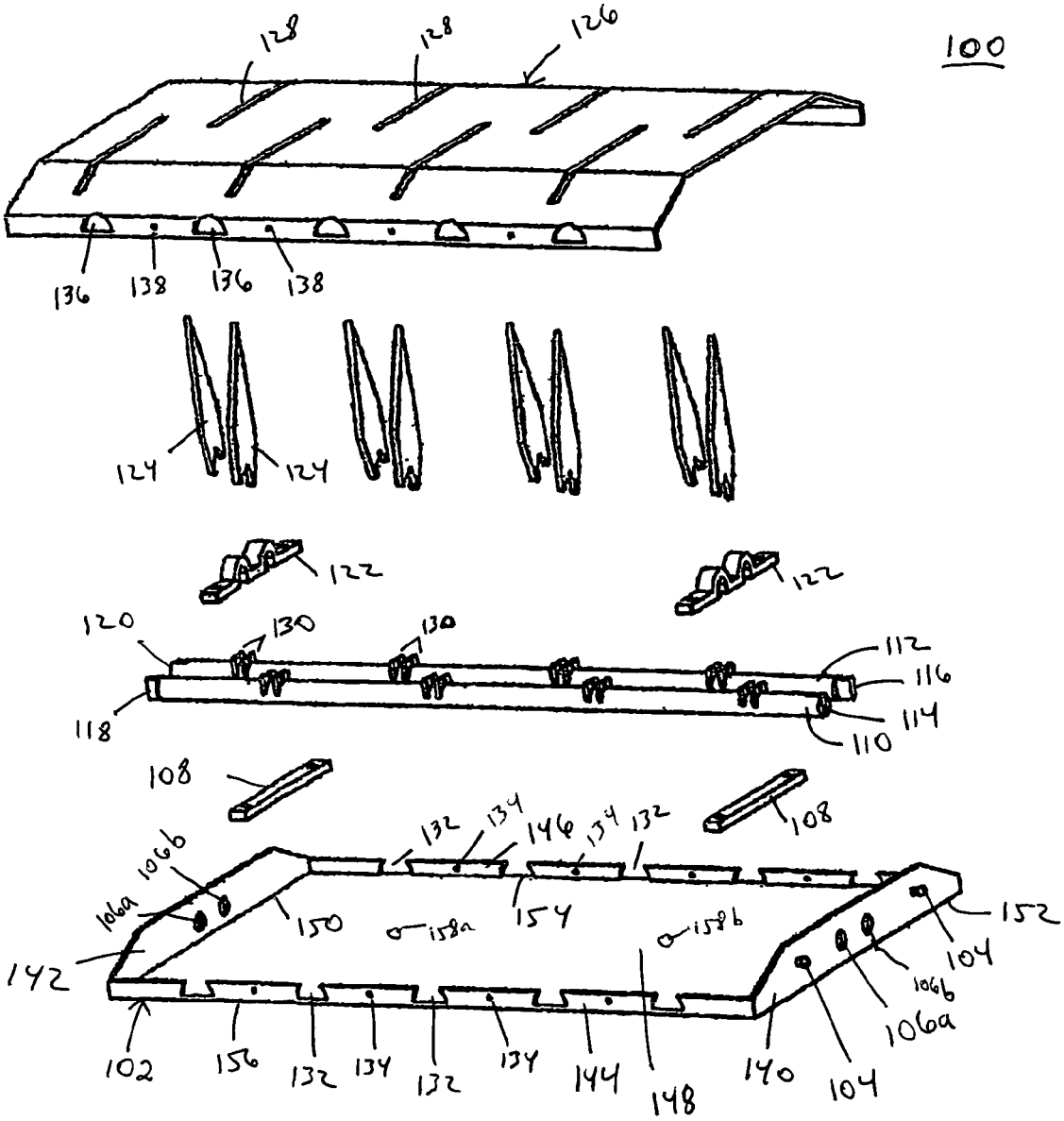
FIG. 1 is an exploded, perspective view showing the elements of a first embodiment of a portable traffic control device of the present invention.

The present invention is directed to a portable traffic control device (PTCD) 100 that uses retractable blades to selectively hinder vehicles from driving through a control point from one or both of two opposing directions. FIGS. 1–5D show a first embodiment of the PTDC 100. In this first embodiment, the PTCD 100 comprises a housing 306, a first shaft 110, a second shaft 112, a first plurality of blades 202 connected to the first shaft 110, and a second plurality of blades 204 connected to the second shaft 112. The PTCD 100 is preferably substantially made of metal, and is most preferably substantially made of steel. However, other suitable materials of generally comparable strength and durability, e.g., durable plastic, composite materials, and rubber, or any combination of such materials, may be used for the construction of the PTCD 100.

The housing 306 preferably comprises a length extending from a first end 140 to a second end 142, a width extending from a first side 144 to a second side 146, a height extending from a bottom 148 to a top, and a plurality of openings 128 in the top of the housing 306. The height of the housing 306 is preferably small such that the PTCD 100 maintains a low profile. A wide variety of vehicles can therefore easily drive over the housing 306 with minimal, if any, difficulty. Additionally, the height of the housing 306 preferably is the smallest near the first side 144 and second side 146, and increases near the center of the housing 306. This type of profile, e.g., a generally trapezoidal, polygonal, or arched shape, enhances the ability of any type of wheeled vehicle to easily drive over the housing 306. Preferably, the height of the housing 306 is therefore about one half inch near the first side 144 and the second side 146, and about one and three-quarters inches near the center of the housing 306. The width of the housing 306 is designed to accommodate the blades 126 when they are retracted within the housing 306 with little excess width that would simply add cost and unnecessary weight to the PTCD 100. Also, the width of the housing 306 is preferably about one foot. The length of the housing 306 is designed to balance the importance of a large effective area covered by a longer PTCD 100 with the easy transportability and use of a shorter PTCD 100. The length of the housing 306 is therefore any desired length, with the preferred length being between fifteen and forty-eight inches. The preferred dimensions of the length, width, and height of the housing 306 are provided for convenience only, and any other dimensions may be used for the housing 306 of the PTCD 100 as dictated by the particular conditions under which the PTCD 100 will be used.

The housing 306 also includes a means for draining any water, snow, gravel, sand, or other material that may collect within the housing 306 by falling through the openings 128 in the top of the housing 306. The preferred means for draining is a plurality of holes 308 regularly spaced around the sides of the housing 306 near the bottom edge. The size, shape, and spacing of the holes 308 are described herein for convenience purpose only. It is readily apparent that a different size, shape, and number of holes 308 may be used according to the intended use of the PTCD 100. For example, if used in extremely wet conditions or a very sandy location, the holes 308 may be bigger than otherwise needed.

In one preferred embodiment, the housing 306 further comprises a base 102 extending from a first end 140 to a second end 142 and extending from a first side 144 to a second side 146, as well as a cover 126 defining the top of the housing 306. The base 102 has a generally flat rectangular bottom 148, a first side 144 and a second side 146 extending upward from the bottom 148 along a first edge 156 and a second edge 154 respectively, and a first end 140 and a second end 142 extending upward from the bottom 148 along a third edge 152 and a fourth edge 150 respectively. In addition, the first side 144 and the second side 146 of the base 102 have a plurality of base cut-outs 132 regularly spaced along the entire length of the base 102. The size, shape, and spacing of the base cut-outs 132 are described herein for convenience purpose only. It is readily apparent that a different size, shape, and number of base cut-outs 132 may be used according to the intended use of the PTCD 100.

The cover 126 attaches to the base 102 and contains the plurality of openings 128 of the housing 306. The cover 126 preferably has two rows of openings 128—a first row of openings: 128 aligned with the first plurality of blades 202 on the first shaft 110 and a second row of openings 128 aligned with the second plurality of blades 204 on the second shaft 112. As a result, when the first shaft 110 is rotated thereby activating the first plurality of blades 202, each blade 124 protrudes through an opening 128 in the first row of openings 124 in the cover 126. Likewise, when the second shaft 112 is rotated thereby activating the second plurality of blades 204, each blade 124 protrudes through the an opening 128 in the second row of openings 128 in the cover 126. As a result, a single PTCD 100 regulates the flow of traffic from either direction. Also, the present invention can prohibit traffic from passing from both directions by rotating both shafts 110, 112 and activating all of the blades 124 in the PTCD 100.

The cover 126 preferably attaches to the first side 140 and second side 142 of the base 102, although it may alternatively be attached to another part of the base 102. The preferred means for securing the cover 126 to the base 102 is a plurality of fasteners 304, e.g., screws, regularly spaced along the sides of the housing 306. That is, a plurality of holes 134 in the first side 144 and second side 146 of the base 102 align with a plurality of holes 138 in the cover 126. The attachment of the cover 126 and the base 102 is described in this design for convenience purpose only. It would be readily apparent to one of ordinary skill in the relevant art to use a different number, type, and placement of fasteners in making the housing 306.

Similar to the base cut-outs 132 of the base 102, the cover 126 has a plurality of top cut-outs 136. The size, shape, and spacing of the top cut-outs 136 is such that when the cover 126 is attached to the base 102, the top cut-outs 136 of the cover 126 align with the base cut-outs 132 of the base 102. Thus, in this embodiment, the means for draining the housing 306 described above comprises the alignment and combination of the top cut-outs 136 with the base cut-outs 132.

The first shaft 110 rotatably connects to the housing 306 and extends a length from about the first end 140 of the housing 306 to about the second end 142 of the housing 306. The first shaft 110 is aligned with a hole 106*a* in each of the first end 140 and the second end 142 such that a male end 118 of the first shaft 110 extends through one hole 106*a* and a female end 114 of the first shaft 110 extends through another hole 106*a*.

Similarly, the second shaft 112 rotatably connects to the housing 306 and extends a length from about the first end 140 of the housing 306 to about the second end 142 of the housing 306. The second shaft 112 is aligned with a hole 106*b* in each of the first end 140 and the second end 142 such that a male end 116 of the second shaft 112 extends through one hole 106*b* and a female end 120 of the first shaft 110 extends through another hole 106*b*.

The first shaft 110 and the second shaft 112 are secured to the bottom 148 of the base 102 of the housing 306 by a plurality of carrier bearing bases 108 and carrier bearing brackets 122. One preferred embodiment, as shown, has two carrier bearing bases 108 and two carrier bearing brackets 122. The carrier bearing bases 108 are secured to the bottom 148 of the base 102 by conventional means, e.g., screws, welding, bolts, fasteners, clips, and the like, and the carrier bearing brackets are attached to the carrier bearing bases 108. Once the carrier bearing bases 108 are secured, the first shaft 110 and the second shaft 112 are placed on top of the carrier bearing bases 108 such that ends 114, 118 of the first shaft 110 extend through holes 106*a*, and the ends 116, 120 of the second shaft 112 extend through holes 106*b*. Once the first shaft 110 and the second shaft 112 are properly positioned, a carrier bearing bracket 122 is secured to each carrier bearing base 108. The carrier bearing brackets 122 have a profile, e.g., a double arch, that matches the shape and size of the exterior top surface of the first shaft 110 and second shaft 112. Thus, when secured to the carrier bearing bases 108, the carrier bearing brackets 122 tightly secure the first shaft 110 and second shaft 112 in place, thereby preventing any lateral movement of the first shaft 110 and second shaft 112 while allowing the first shaft 110 and second shaft 112 to rotate.

Figure 2:
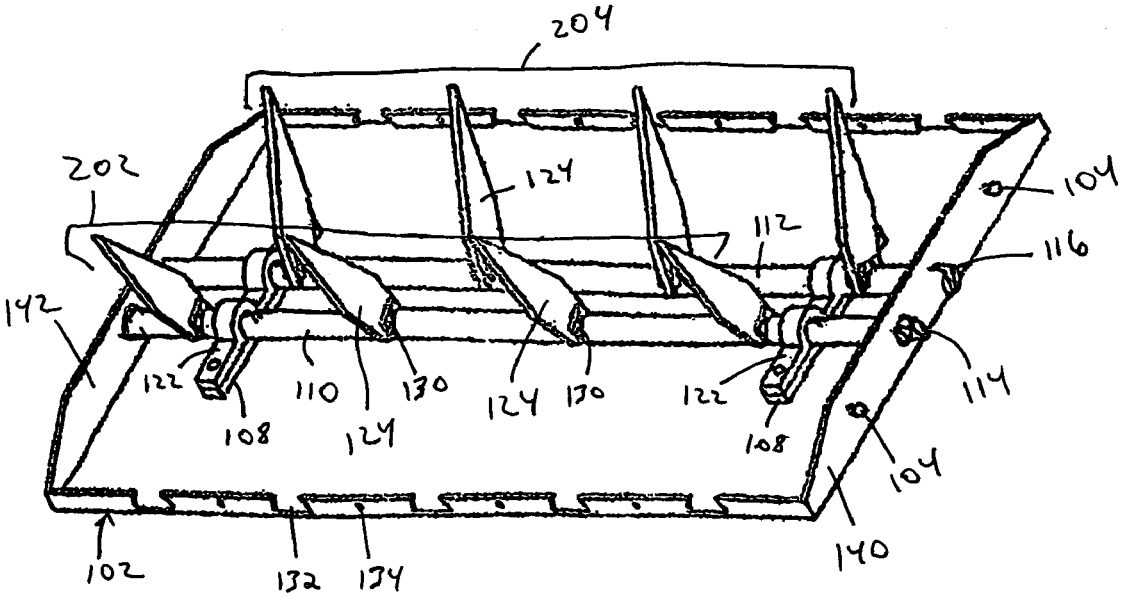
FIG. 2 is a perspective view showing a base of the portable traffic control device having both rows of blades activated.
Figure 3A:
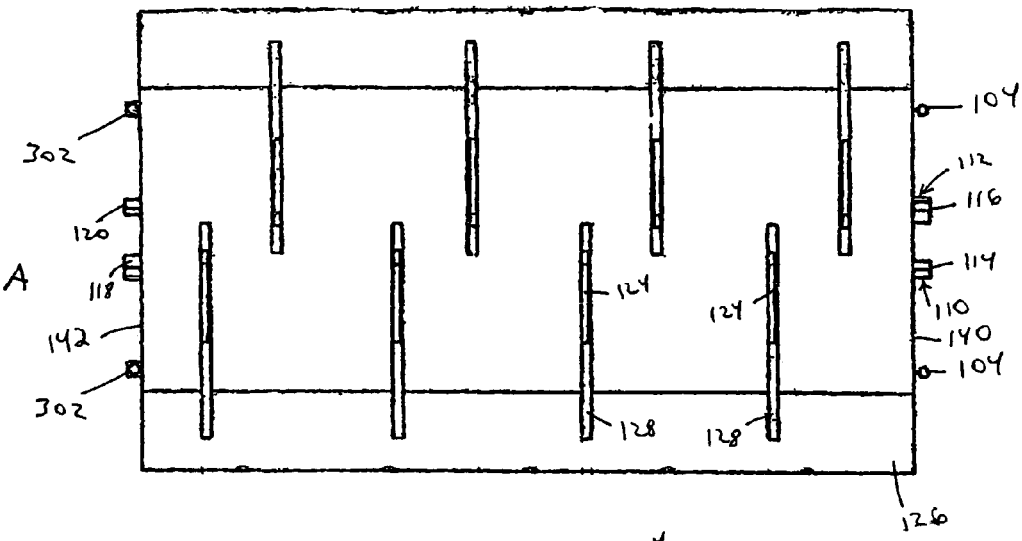
FIG. 3A is a planar top view of the portable traffic control device having both rows of blades activated.
Figure 3B:
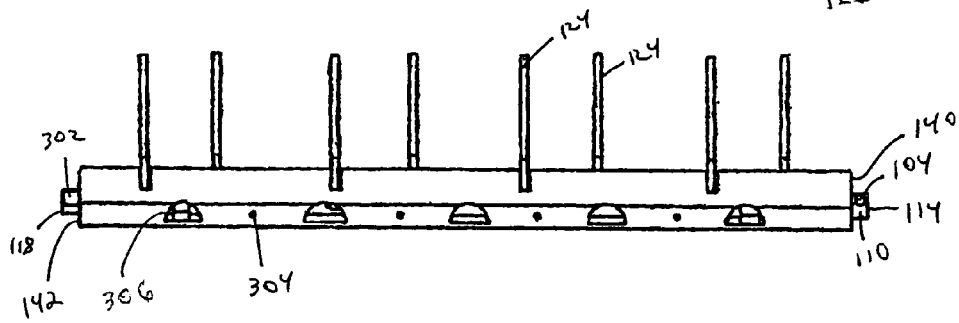
FIG. 3B is a planar side view of the portable traffic control device having both rows of blades activated.
Figure 3C:
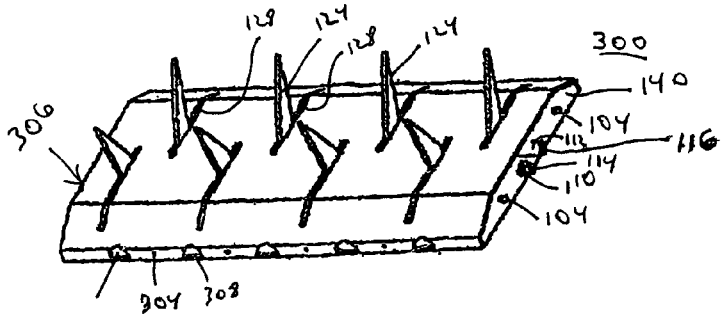
FIG. 3C is a perspective view of the portable traffic control device having both rows of blades activated.
Figure 3D:
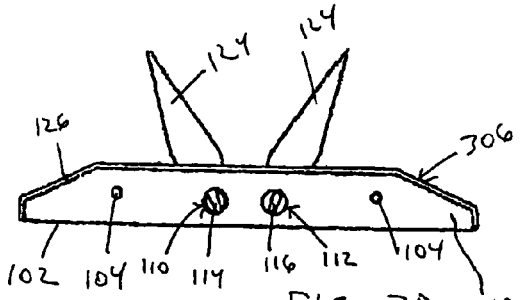
FIG. 3D is a planar end view of the portable traffic control device having both rows of blades activated.
Figure 4A:
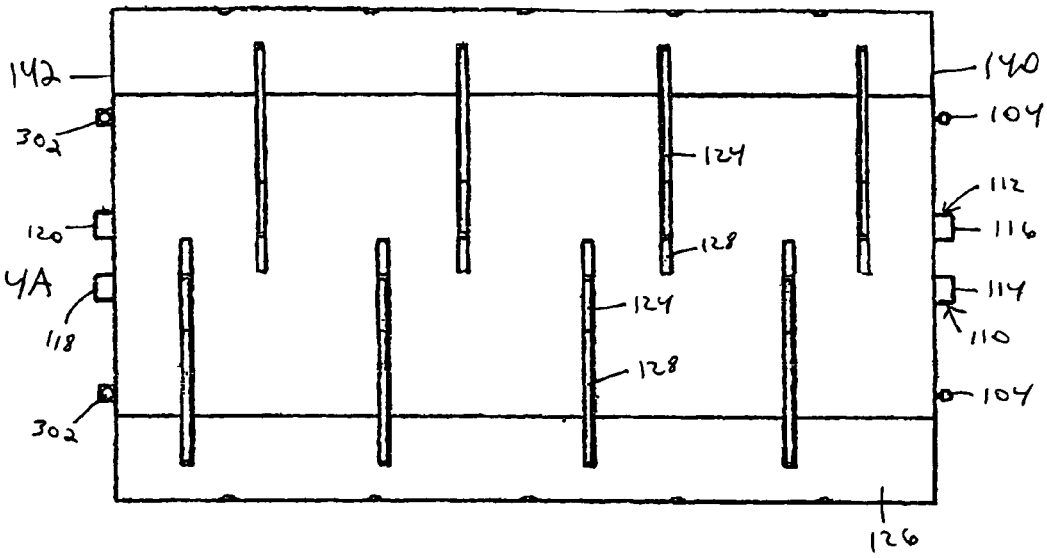
FIG. 4A is a planar top view of the portable traffic control device having both rows of blades deactivated.
Figure 4B:
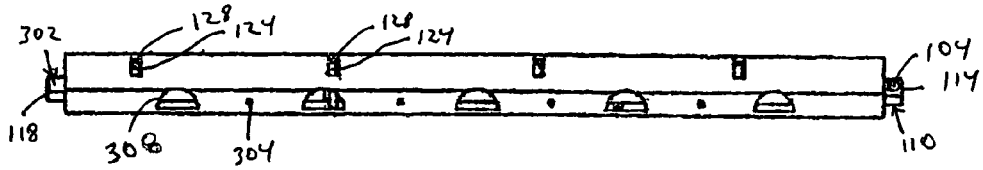
FIG. 4B is a planar side view of the portable traffic control device having both rows of blades deactivated.
Figure 4C:
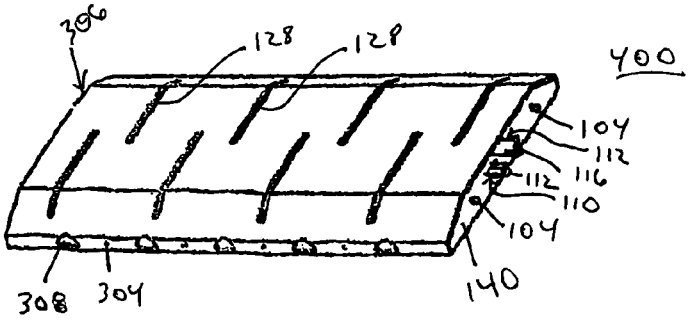
FIG. 4C is a perspective view of the portable traffic control device having both rows of blades deactivated.
Figure 4D:
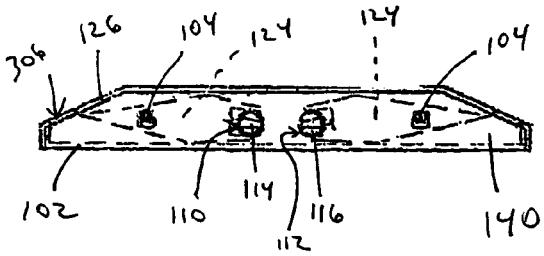
FIG. 4D is a planar end view of the portable traffic control device having both rows of blades deactivated.
Figure 5A:
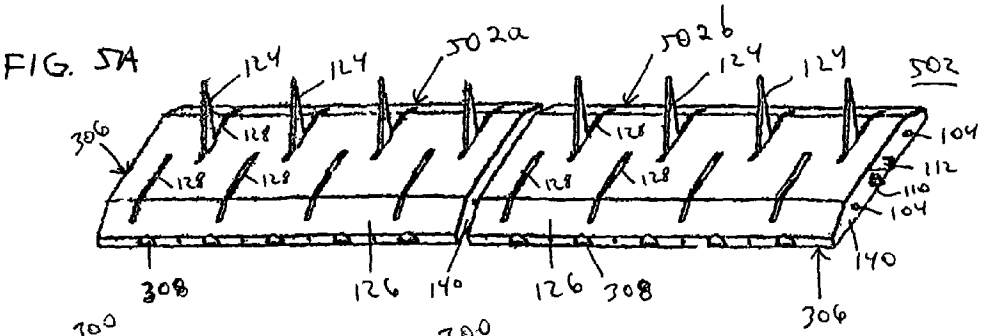
FIG. 5A is a perspective view of the portable traffic control device having a first row of blades activates and a second row of blades deactivated.
Figure 5B:
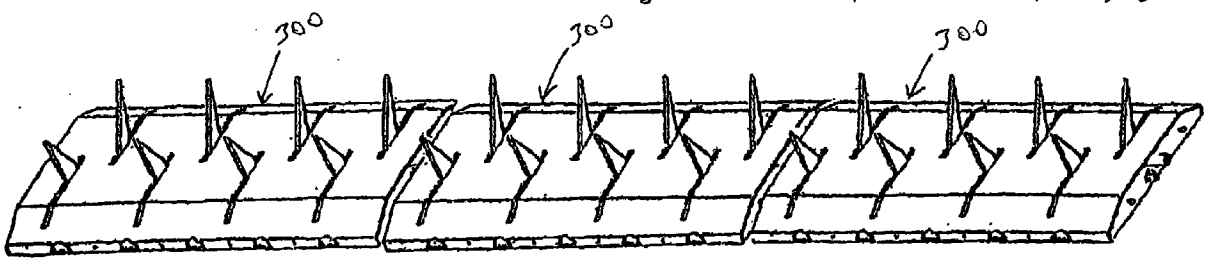
FIG. 5B is a perspective view of the portable traffic control device having both a first row of blades and a second row of blades activated.
Figure 5C:
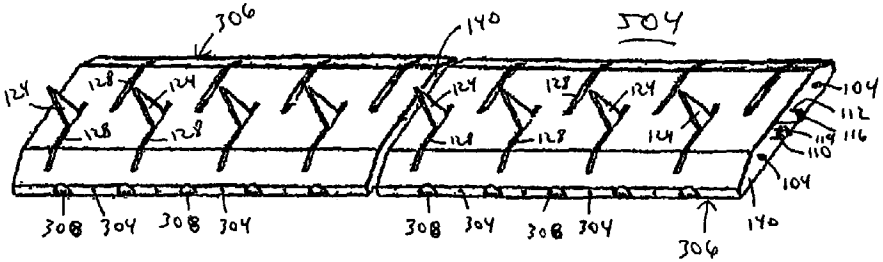
FIG. 5C is a perspective view of the portable traffic control device having a first row of blades deactivated and a second row of blades activated.
Figure 5D:
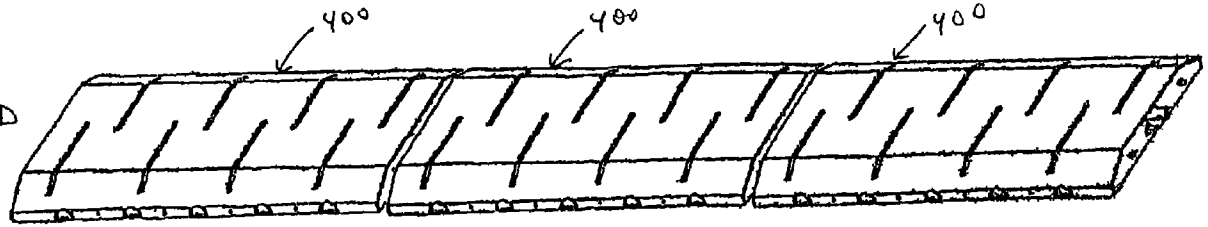
FIG. 5D is a perspective view of the portable traffic control device having both a first row of blades and a second row of blades deactivated.
Figure 6A:
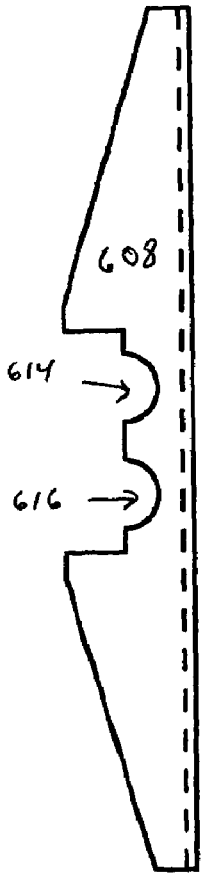
FIG. 6A is a planar view of a first end of a carrier bearing base of a preferred embodiment of the present invention.
Figure 6B:
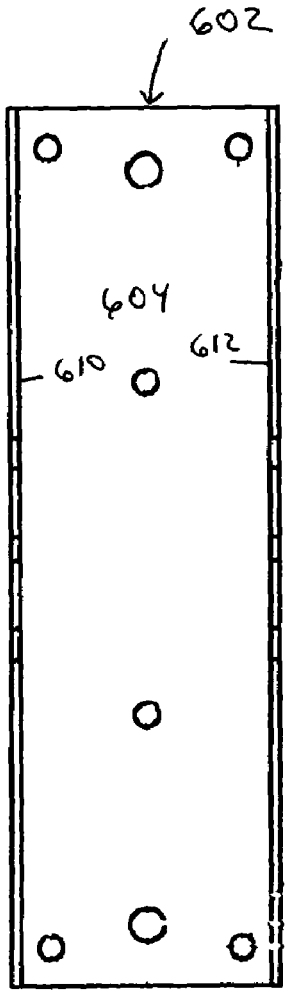
FIG. 6B is a planar top view of the carrier bearing base.
Figure 6C:
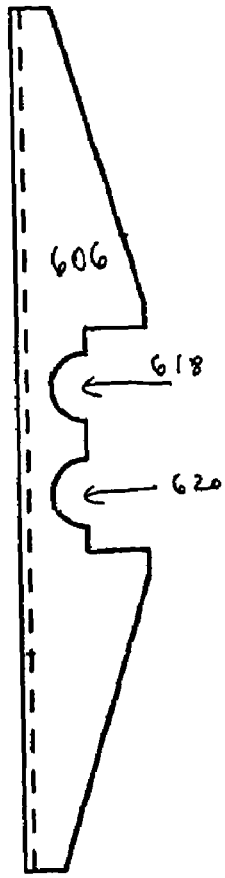
FIG. 6C is a planar view of a second end of the carrier bearing base.
Figure 7:
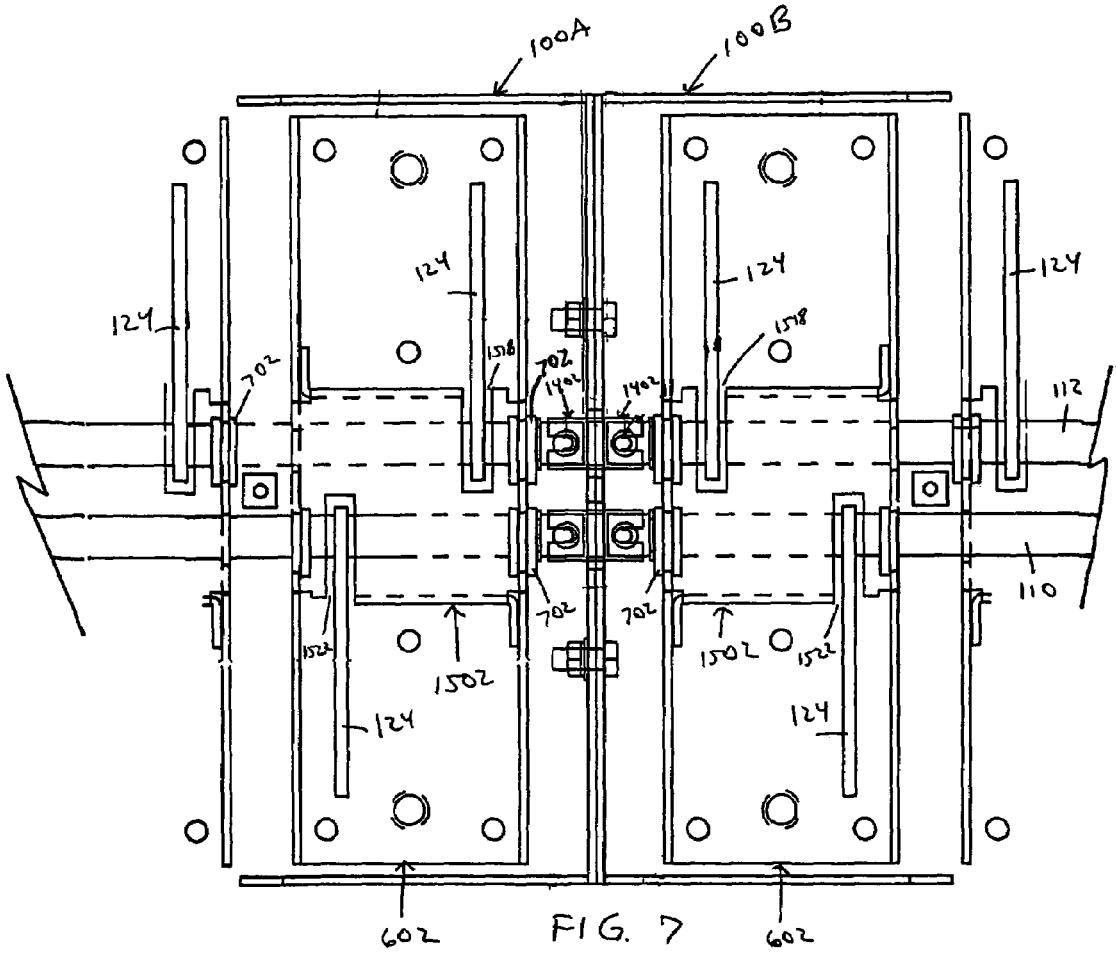
FIG. 7 is a planar top view of a portion of a base containing two carrier bearing bases.
Figure 14A:
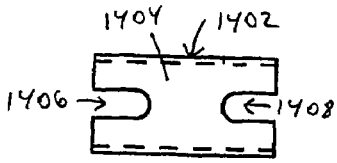
FIG. 14A is a planar top view of a base connector.
Figure 14B:
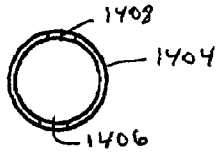
FIG. 14B is a planar end view of the base connector.
Figure 8A:
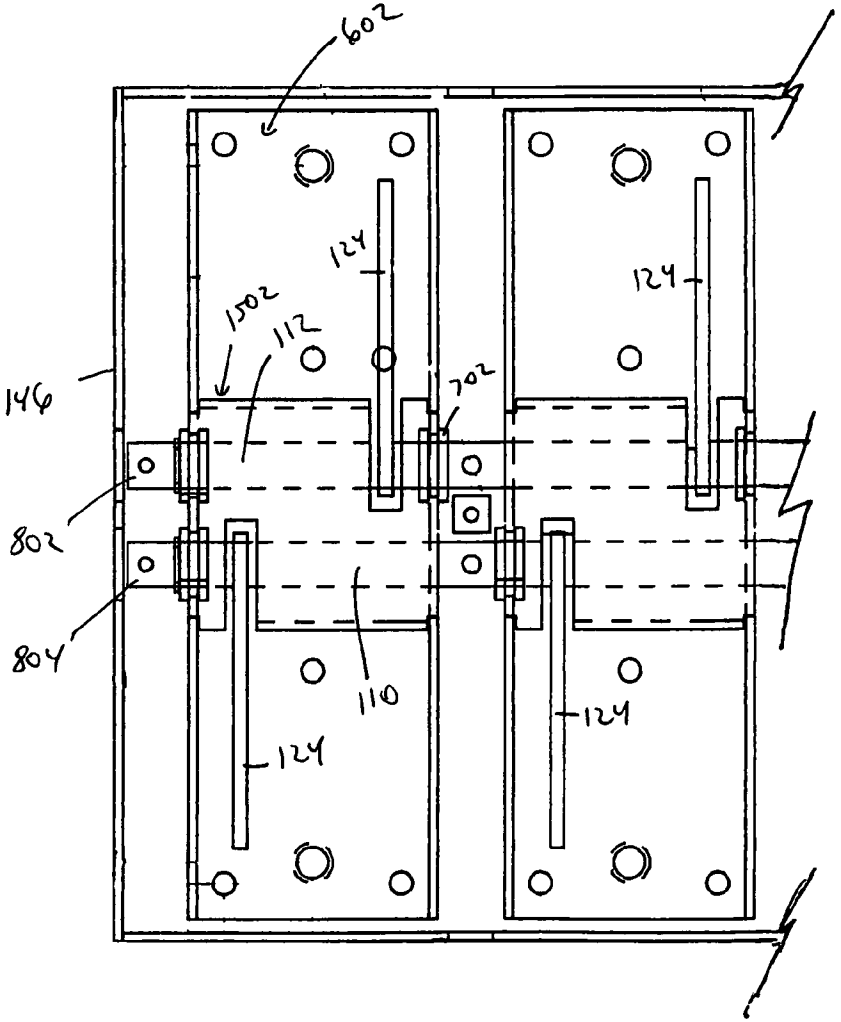
FIG. 8A is a planar top view of a first end of a base containing two carrier bearing bases.
Figure 8B:
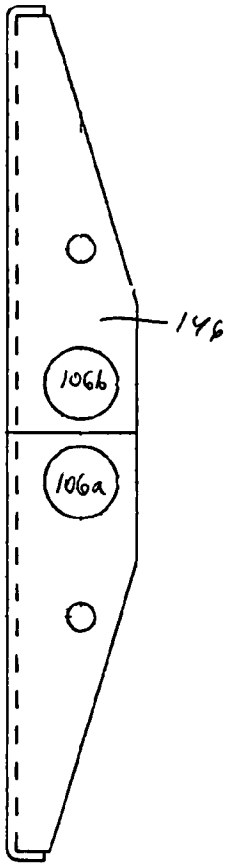
FIG. 8B is a planar view of an end of a carrier bearing base of the present invention.

The first plurality of blades 202 has a predefined number of individual blades 124 arranged at regular intervals in a row across the length of the first shaft 110. Each blade 124 is secured to the first shaft 110 such that as the first shaft 110 rotates, the first plurality of blades 202 rotates. As shown in FIGS. 1 and 2, each blade 124 is secured to the first shaft 110 by attaching a bottom of the blade 124 to a blade collar 130 on the first shaft 110. The bottom of a blade 124 is inserted into the blade collar 130 and secured thereto by a fastener, e.g., a screw, bolt, rivet, and the like, or by welding. However, other suitable means of securing a blade 124 to the first shaft 110 may be used. The first shaft 110 can be rotated such that each blade 124 of the first plurality of blades 202 has a first position (up) extending generally upward through an opening 128 of the plurality of openings 128 in the top of the housing 306. In the first position, each blade 124 of the first plurality of blades 202 extends generally upward from the first shaft 110 toward the first side 144 of the base 102. The preferred angle of the blades 124 is within the range of forty-five to fifty-five degrees, with a preferred embodiment of about fifty degrees, as measured from the bottom 148 of the base 102. The first shaft 110 can also be rotated such that each blade 124 of the first plurality of blades 202 has a second position (down) extending generally horizontally within the housing 306 under the cover 126. Preferably, the blades 124 in the second position extend from the first shaft 110 toward the first side 144 of the base 102.

Similarly, the second plurality of blades 204 has a predefined number of individual blades 124 arranged at regular intervals in a row across the length of the second shaft 112. Each blade 124 is secured to the second shaft 112 in the same manner as the blades 124 secured to the first shaft 110 described above. The second shaft 112 can be rotated such that each blade 124 of the second plurality of blades 204 has a primary position (up) extending generally upward through an opening 128 of the plurality of openings 128 in the top of the housing 306. In the primary position, each blade 124 of the second plurality of blades 204 extends generally upward from the second shaft 112 toward the second side 146 of the base 102. The preferred angle of the blades 124 is within the range of forty-five to fifty-five degrees, with a preferred embodiment of about fifty degrees, as measured from the bottom 148 of the base 102. The second shaft 112 also can be rotated such that each blade 124 of the second plurality of blades 204 has a secondary position (down) extending generally horizontally within the housing 306 under the cover 126. Preferably, the blades 124 in the secondary position extend from the second shaft 112 toward the second side 146 of the base 102.

In this embodiment, the PTCD 100 also comprises a control means for rotating the first shaft 110 such that each blade 124 of the first plurality of blades 202 moves between the first position and the second position. The control means also independently rotates the second shaft 112 such that each blade 124 of the second plurality of blades 204 moves between the primary position and the secondary position. Once a PTCD 100 is deployed, a user engages the control means for rotating in order to set all of the blades 124 in a desired position. The control means for rotating is described in detail below.

The PTCD 100 is also modular in that one PTCD 100 may be detachably connected to one or more other PTCDs 100. In one embodiment, the first end 140 of the housing 306 has one or more protruding male fasteners 104. These male fasteners 104 align with a corresponding number of female receptors 302 protruding from the second side 142 of an adjacent PTCD 100. Therefore, to attach two PTCDs 100, the male fasteners 104 of a first PTCD 100 are aligned with and inserted into the female receptors 302 of a second PTCD 100. The preferred type of fasteners are a ball-and-socket arrangement, but this is just for convenience. It would be readily apparent to one or ordinary skill in the relevant art to use a comparable means for detachably connected two PTCDs 100, e.g., screws, bolts, and the like.

When detachably connecting multiple PTCDs 100, the shafts 110, 112 of each PTCD 100 also must be connected such that the rotation of one shaft results in the rotation of all connected shafts. For example, as shown, the first shaft 110 has a male end 118 and a female end 114. Thus, when connecting two PTCDs 502*a,b*, the female end 114 of the first shaft 110 in the first PTCD 502*a* connects to the male end 118 of the first shaft 110 in the second PTCD 502*b*, and the male end 116 of the second shaft 112 in the first PTCD 100 connects to the female end 120 of the second shaft 112 in the second PTCD 502*b*. Once connected, one control means as described below can be used to rotate all of the first shafts 110 and all of the second shafts 112 of the connected PTCDs 100.

Optionally, the PTDC 100 may be anchored to the underlying surface prior to use. For example, the housing 306 may be bolted or screwed to the roadway, or other surface, via holes 158*a, b* in the bottom 148 of the base 102. Securing the PTCD 100 to the underlying surface will enhance the stability of the PTCD 100 during its use, as well as, will prevent the PTCD 100 from being moved out of position while it is unattended.

In operation, a first PTCD 100 is placed on a surface traversed by wheeled vehicles, such that the length of the housing 306 extends perpendicular to the direction of travel of the vehicles. Additional PTCDs 100 may be detachably connected to the first PTCD 100, as described above, if additional length is desired to effectively cover the width of the surface to be protected. Furthermore, one or all of the attached PTCDs 100 may be anchored to the underlying surface. Once the desired number of PTCDs 100 are connected and anchored, the control means is then used to rotate the first shaft 110 and the second shaft 112 such that the blades 124 of the first plurality of blades 202 and the blades 124 of the second plurality of blades 204 are positioned as desired.

For example, to hinder the passage of vehicles traveling from both directions along the surface, the control means rotates the first shaft 110 such that the blades 124 of the first plurality of blades 202 are all in the first position (up), and the control means rotates the second shaft 112 such that the blades 124 of the second plurality of blades 204 are all in the primary position (up). See FIG. 5B. To hinder only the passage of vehicles approaching from a direction nearest the first shaft 110, the control means rotates the first shaft 110 such that the blades 124 of the first plurality of blades 202 are all in the first position (up), and the control means rotates the second shaft 112 such that the blades 124 of the second plurality of blades 204 are all in the secondary position (down). See FIG. 5C. To hinder only the passage of vehicles approaching from a direction nearest the second shaft 112, the control means rotates the first shaft 110 such that the blades 124 of the first plurality of blades 202 are all in the second position (down), and the control means rotates the second shaft 112 such that the blades 124 of the second plurality of blades 204 are all in the primary position (up). See FIG. 5A. To permit unhindered passage of all vehicles, the control means rotates the first shaft 110 such that the blades 124 of the first plurality of blades 202 are all in the second position (down), and the control means rotates the second shaft 112 such that the blades 124 of the second plurality of blades 204 are all in the secondary position (down). See FIG. 5D.

Figure 9:
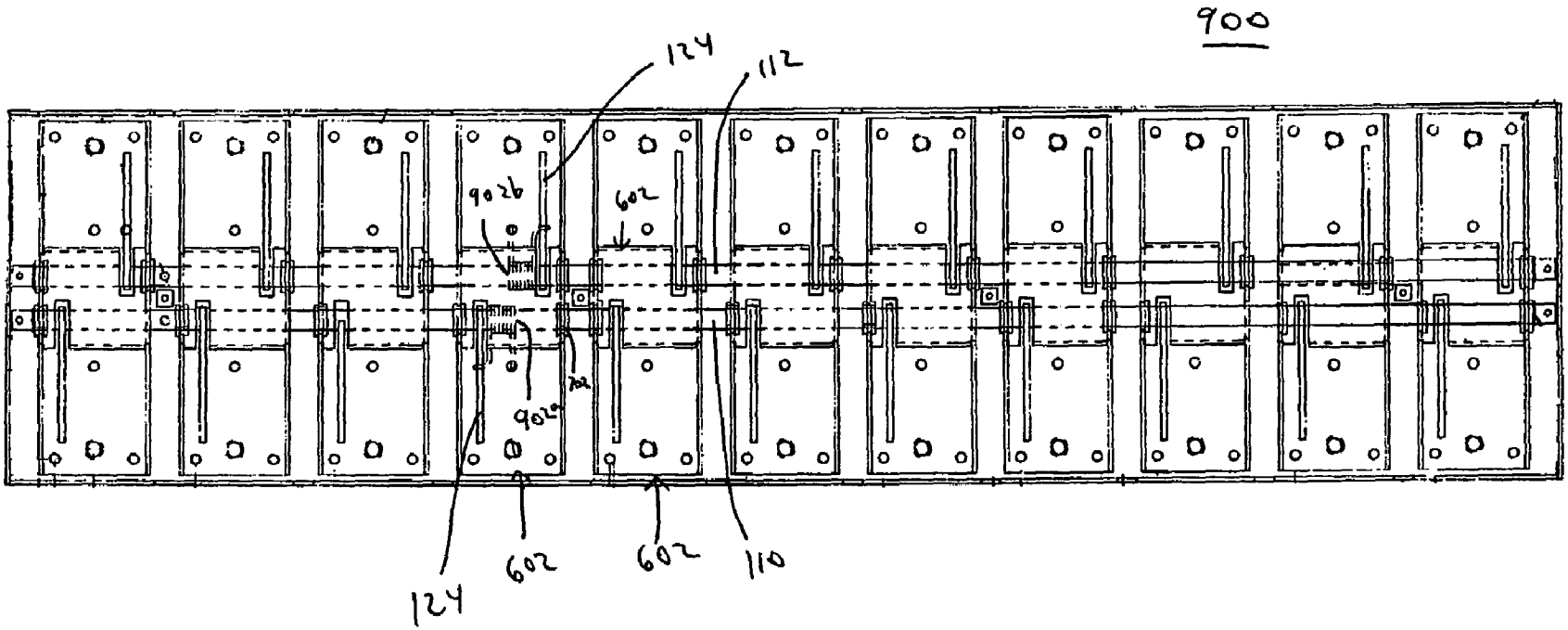
FIG. 9 is a planar top view of a base containing eleven carrier bearing bases.
Figure 10:
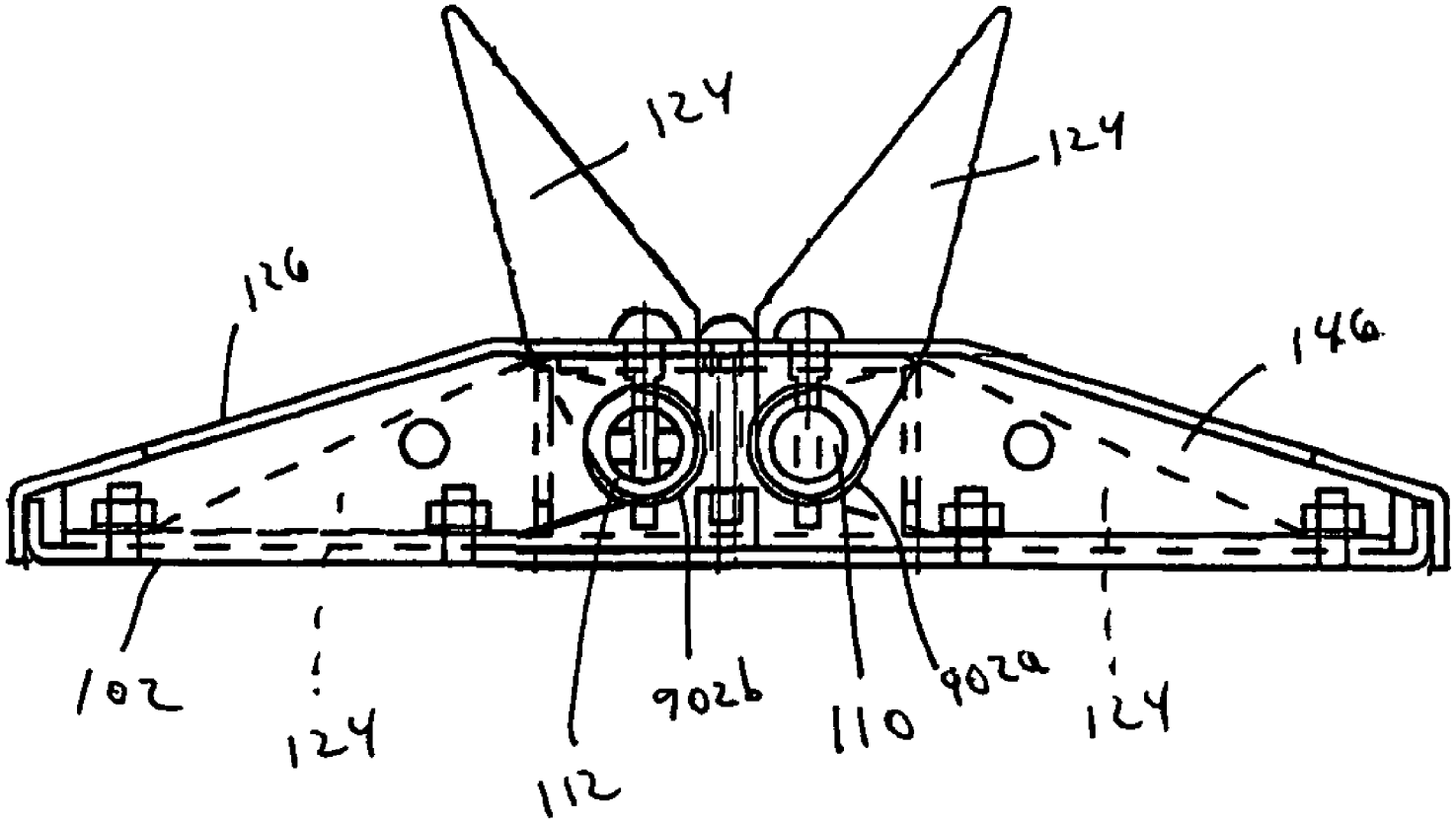
FIG. 10 is a planar end view of the alternative embodiment of the present invention showing the base, the carrier bearing base, and a pair of blades activated.

A preferred embodiment of the present invention is shown in FIGS. 6–15E. In this preferred embodiment, the first shaft 110 with the first plurality of blades 202, the second shaft 112 with the second plurality of blades 204, and a biasing means are secured within the housing 306 of a PTCD 100 by an internal sub-assembly system. The internal sub-assembly system comprises a plurality of reinforcing channel sub-bases 602 attached to the bottom 148 of the base 102 and a bushing clamp 1502 is secured to the top of a center portion of each of the reinforcing channel sub-bases 602. Each reinforcing channel sub-base 602 has a bottom 604 having a first edge 610 and a second edge 612, a first side 608 having first guiding recess 616 adapted to receive the first shaft 110 and a second guiding recess 614 adapted to receive the second shaft 112, a second side 606 having first guiding recess 620 adapted to receive the first shaft 110 and a second guiding recess 618 adapted to receive the second shaft 112. The preferred reinforcing channel sub-bases 602 are adapted to contain two blades 124—one attached to the first shaft 110 and one attached to the second shaft 112, but this for convenience. It would be readily apparent to design a reinforcing channel sub-bases 602 to hold a different number of blades 124. A preferred PTCD 900 as shown in FIG. 9 has eleven reinforcing channel sub-bases 602 contained in the housing 306, but this is also for convenience. It would be readily apparent to design a housing 306 of the present invention containing any number of reinforcing channel sub-bases 602.

Each bushing clamp 1502 is adapted to fit on top of the central portion of a reinforcing channel sub-base 602. Specifically, a bushing clamp 1502 comprises a top 1504, a first side 1516, a second side 1520, a third side 1506 having a first guiding recess 1524 and a second guiding recess 1510, and a fourth side 1508 having a first guiding recess 1514 and a second guiding recess 1512. Thus, when positioned above a reinforcing channel sub-base 602, the first guiding recess

1524 of the third side 1506 and the first guiding recess 1514 of the fourth side 1508 of the bushing clamp 1502 align respectively with the first guiding recess 616 of the first side 608 and the first guiding recess 620 of the second side 606 of the reinforcing channel sub-base 602, as well as, the second guiding recess 1510 of the third side 1506 and the second guiding recess 1512 of the fourth side 1508 of the bushing clamp 1502 align respectively with the second guiding recess 614 of the first side 608 and the second guiding recess 618 of the second side 606 of the reinforcing channel sub-base 602. This arrangement results in two channels being formed through which the first shaft 110 and second shaft 112 extend respectively. A bushing clamp 1502 of the present invention is secured to a reinforcing channel sub-base 602 by conventional means, including, pressure fitting, mechanical fasteners, and/or clips.

Optionally, a bushing or collar 702 can be used around the first shaft 110 at the point at which the first shaft 110 passes through a channel formed by the reinforcing channel sub-base 602 and a bushing clamp 1502. Likewise, the bushing or collar 702 can be used around the second shaft 112 at the point at which the second shaft 112 passes through a channel formed by the reinforcing channel sub-base 602 and a bushing clamp 1502. The collar 702 can be made of a material that protects the exterior surface of the first shaft 110 and second shaft 112, while allowing the first shaft 110 and second shaft 112 to rotate. Possible materials for a collar 702 include, but are not limited to, a composite, plastic, rubber, metal, and the like.

The top 1504 of a bushing clamp 1502 also has a first slot 1522 that extends into the first side 1516 and a second slot 1518 that extends into the second side 1520. The first slot 1518 is a size and position such that it aligns with a blade 124 of the first plurality of blades 202 attached to the first shaft 110. Thus, as the first shaft 110 rotates, the blade 124 aligned with the first slot 1518 rotates through the first slot 1518 as it moves between the first position and second position. Likewise, the second slot 1522 is a size and position such that it aligns with a blade 124 of the second plurality of blades 204 attached to the second shaft 112. Thus, as the second shaft 112 rotates, the blade 124 aligned with the second slot 1522 rotates through the second slot 1522 as it moves between the primary position and secondary position. Although FIG. 15A–E shows a bushing clamp 1502 of a predefined orientation, this is for convenience. It would be readily apparent to one of ordinary skill in the art to design, make, and use a bushing clamp 1502 having an inverse orientation to accommodate a different order of blades 124 on a first shaft 110 and second shaft 112.

The preferred embodiment of a PTCD 100 further comprises a biasing means for urging each blade 124 of the first plurality of blades 202 on a first shaft 110 to rotate toward the first position (up) and each blade 124 of the second plurality of blades 204 on a second shaft 112 to rotate toward the primary position (up). The biasing means is preferably at least one torsion spring 902*a* located in contact with at least one blade 124 of the first plurality of blades 202 and at least one torsion spring 902*b* located in contact with at least one blade 124 of the second plurality of blades 204. Thus, there is at least two torsion springs 902 contained with the housing 306 of a PTCD 100—one torsion spring 902*a* used with the first shaft 110 and one torsion spring 902*b* used with the second shaft 112.

In another embodiment, one torsion spring 902 is located in contact with one blade 124 of the first plurality of blades 202 near the first end 144 of the housing 306, and a second torsion spring 902 is located in contact with another blade 124 of the first plurality of blades 202 near the second end 146 of the housing 306. Likewise, one torsion spring 902 is located in contact with one blade 124 of the second plurality of blades 204 near the first end 144 of the housing 306, and a second torsion spring 902 is located in contact with another blade 124 of the second plurality of blades 204 near the second end 146 of the housing 306. Thus, in this embodiment, there are four torsion springs 902 contained within a housing 306 of a PTCD 100—two torsion springs 902 for each of the first shaft 110 and second shaft 112. The number and placement of torsion springs 902 used with a PTCD 100 can vary as needed.

Figure 11B:
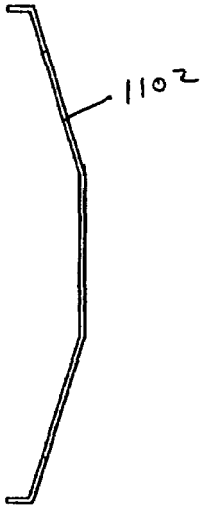
FIG. 11B is a planar end view of the cover.
Figure 11A:
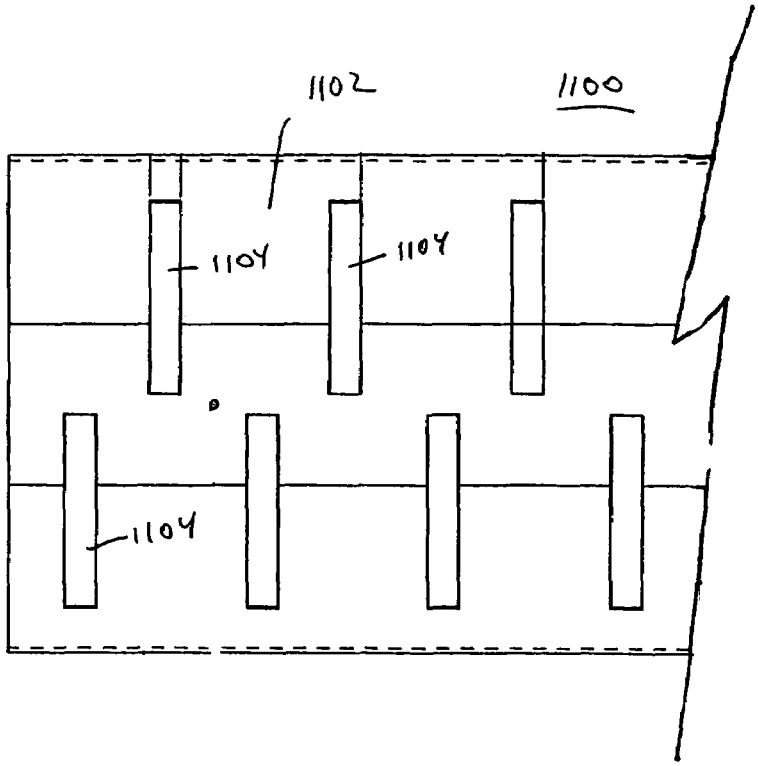
FIG. 11A is planar view of the top of a portion of a cover for the base.
Figure 12A:
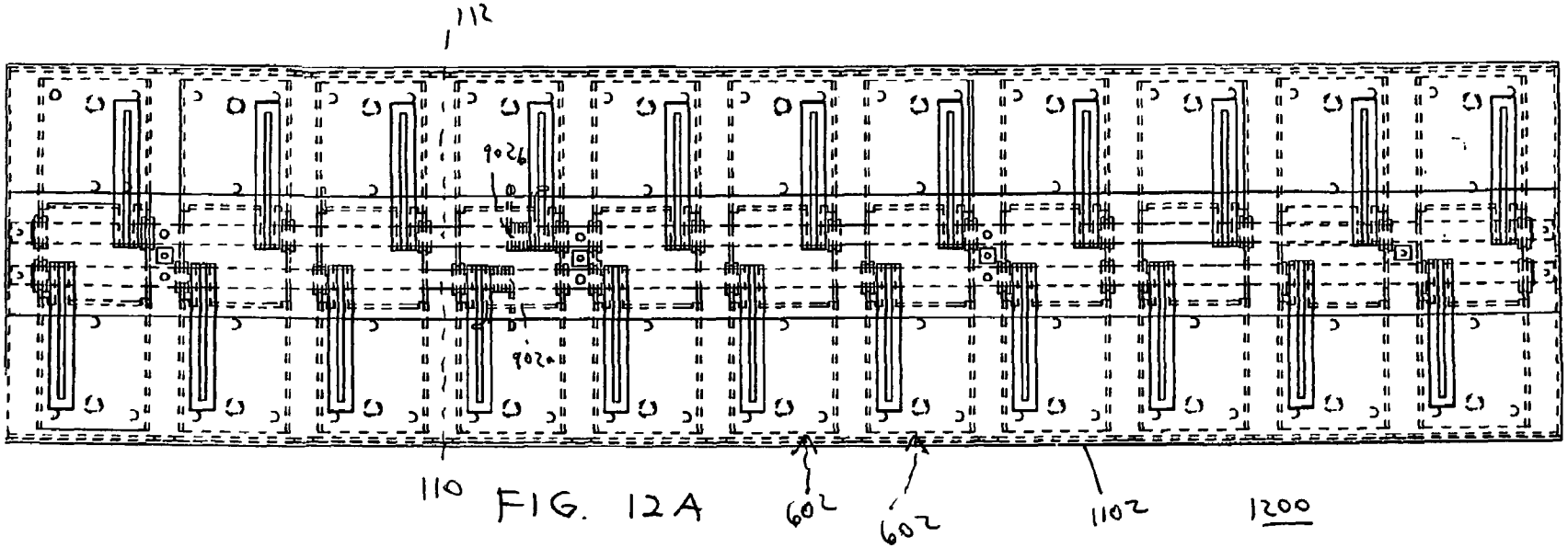
FIG. 12A is a planar top view of the alternative embodiment of the present invention showing the cover, the base, and eleven pairs of blades activated.
Figure 12B:
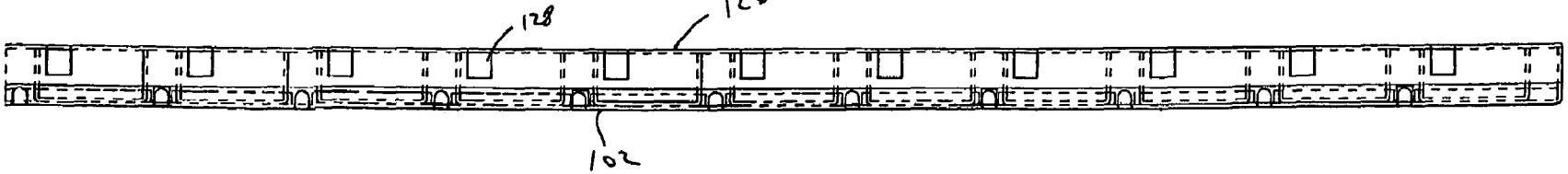
FIG. 12B is a planar side view of the alternative embodiment of the present invention showing the cover, the base, and eleven pairs of blades deactivated.
Figure 13A:
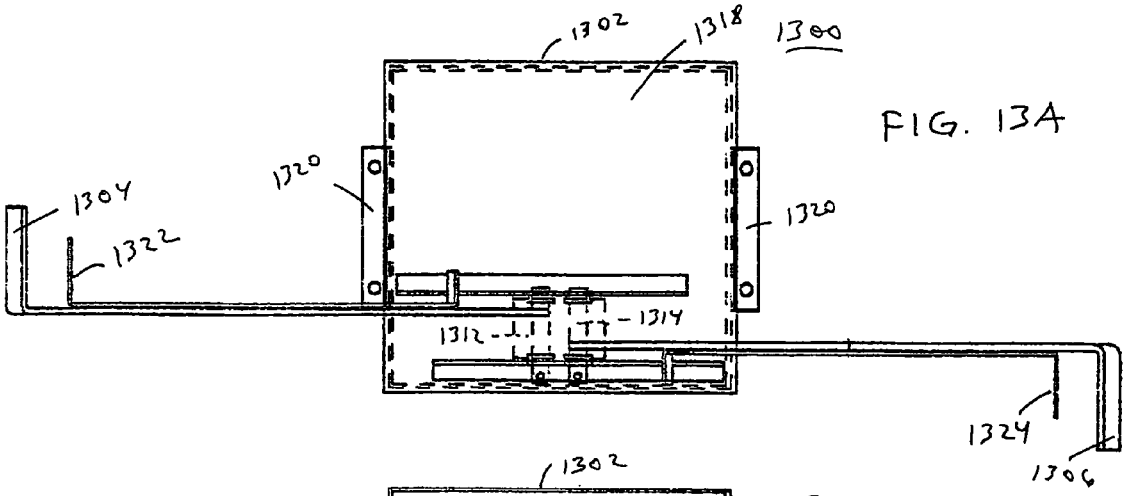
FIG. 13A is a planar top view of a control box of the present invention with a box cover.
Figure 13B:
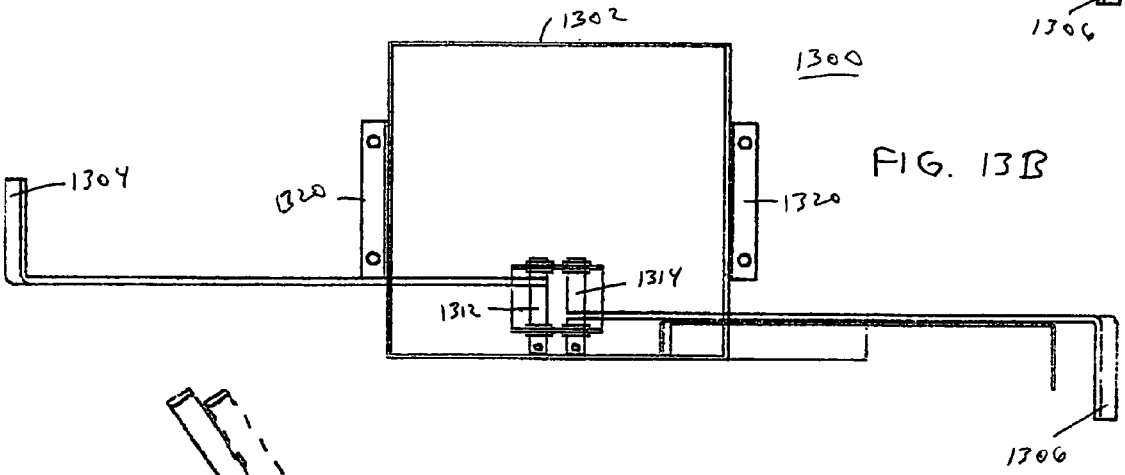
FIG. 13B is a planar top view of the control box without a box cover.
Figure 13C:
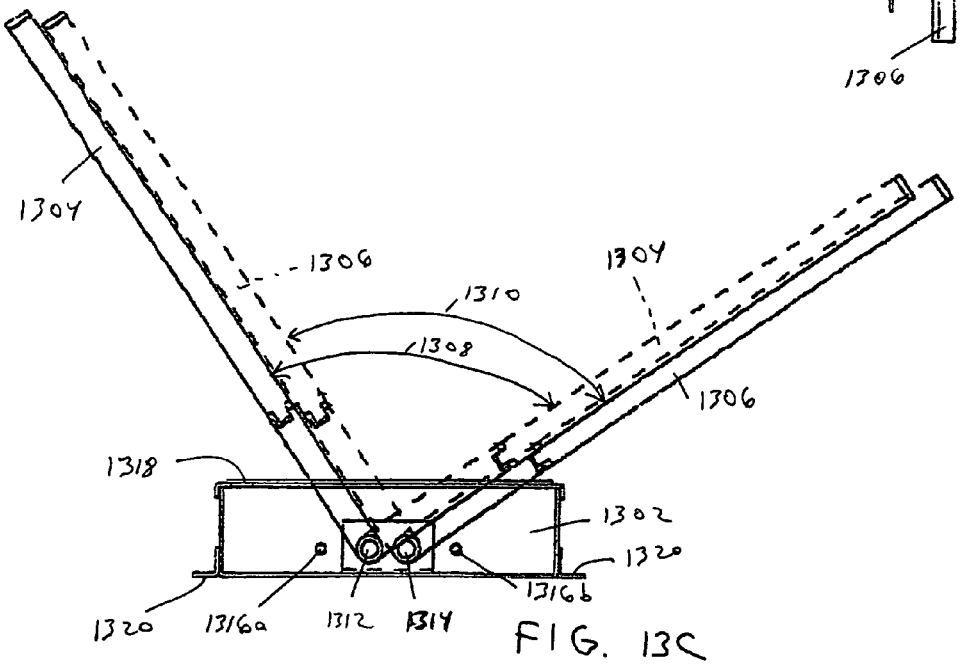
FIG. 13C is a planar side view of the control box.
Figure 15B:
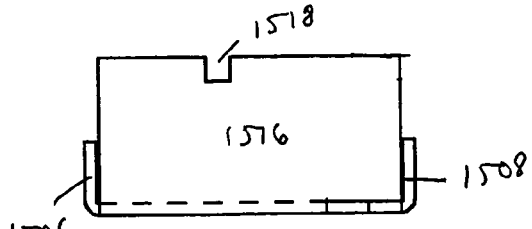
FIG. 15B is a planar view of a first side of the bushing clamp.
Figure 15D:
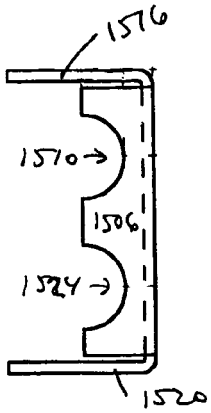
FIG. 15D is a planar view of a third side of the bushing clamp.
Figure 15A:
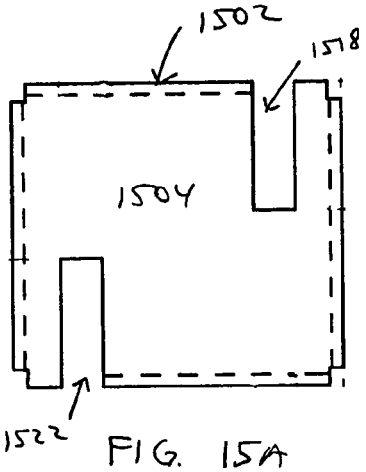
FIG. 15A is a planar top view of a bushing clamp.
Figure 15E:
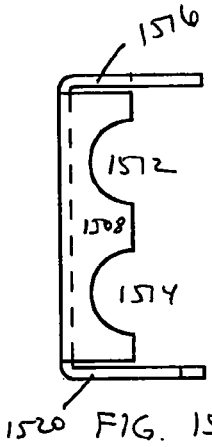
FIG. 15E is a planar view of a fourth side of the bushing clamp.
Figure 15C:
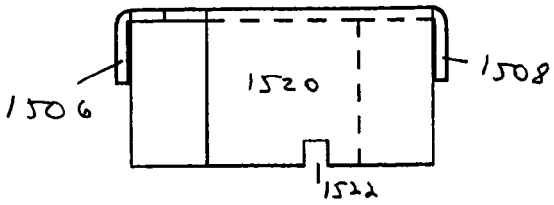
FIG. 15C is a planar view of a second side of the bushing clamp.

As shown in FIG. 11, a cover 1102 is preferably used as the top of the housing 306 in the preferred PTCD 900. The cover 1102 is sized to accommodate the base 102 and internal sub-assembly systems 602 contained in the housing 306. Similar to the cover 126, this cover 1102 also has a polygonal profile and contains a plurality of opening 1104 that align with the blades 124 of the first plurality of blades 202 attached to the first shaft 110 and the blades 124 of the second plurality of blades 204 attached to the second shaft 112. FIGS. 12A, B show the cover 1102 attached to the preferred PTCD 900.

Also, in the preferred embodiment the PTCD 100 of the present invention, the PTCD 100 comprises a control means for enabling a user to independently rotate the first shaft 110 and the second shaft 112. By activating the control means, a user can rotate the first shaft 110 such that each blade 124 of the first plurality of blades 202 moves between the first position and the second position. The control means also enables the user to independently rotate the second shaft 112 such that each blade 124 of the second plurality of blades 204 moves between the primary position and the secondary position.

In a most preferred embodiment of the PTCD 100, the control means is a rotary manual control box 1300. The rotary manual control box 1300 comprises a control box housing 1302, a first lever arm 1304, a second lever arm 1306, a first control shaft 1312, and a second control shaft 1314. The control box housing 1302 serves as a point of connection and provides some physical protection for the rotary manual control box 1300. The first control shaft 1312 is rotatably connected to the control box housing 1302 and is connected to the first shaft 112 of the PTCD 100 such that rotation of the first control shaft 1312 results in a corresponding rotation of the first shaft 110 and the first plurality of blades 202 attached thereto. Likewise, the second control shaft 1314 is rotatably connected to the control box housing 1302 and is connected to the second shaft 112 of the PTCD 100 such that rotation of the second control shaft 1314 results in a corresponding rotation of the second shaft 112 and the second plurality of blades 204 attached thereto. The first lever arm 1304 is connected to the first control shaft 1312, and the second lever arm 1306 is connected to the second control shaft 1320.

The use of one lever arm 1304, 1306 for each shaft 110, 112, provides the means for a user to operate each shaft 110, 112 independent of the other. For example, the first lever arm 1304 serves as a handle for rotating the first control shaft 1312 which, in turn, rotates the first shaft 110 and which, in turn, rotates the first plurality of blades 202 such that each blade 124 of the first plurality of blades 202 moves, see motion 1308, between the first position and the second position. Likewise, the second lever arm 1306 serves as a handle for rotating the second control shaft 1314 which, in turn, rotates the second shaft 112 and which, in turn, rotates the second plurality of blades 204 such that each blade 124 of the second plurality of blades 204 moves, see motion 1310, between the primary position and the secondary position.

Optionally, a first locking arm 1322 may be in communication with the first lever arm 1304 wherein the first locking arm 1322 locks the first lever arm 1304 in the desired position, thereby locking the first plurality of blades 202 in either the first position or second position. The first locking arm 1322 is preferably a conventional racheting or gear type system whereby the distal end of the first locking arm 1322 fits within one of several notches. In operation, the user, pulls the first locking arm 1322 to release its distal end, thereby enabling the first locking arm 1322 and the first lever arm 1304 to move freely. Upon release, the distal end of the first locking arm 1322 falls within a predefined notch, thereby locking the first locking arm 1322 and the first lever arm 1304 into place. A second locking arm 1324 is in communication with the second lever arm 1306 by similar means. Also, the use of a gear-type system is for convenience purposes only. It would be readily apparent to one of ordinary skill in the relevant art to use a comparable means for locking the first lever arm 1304 and the second lever arm 1306 into the desired position.

Preferably, the first control shaft 1312 is detachably connected to the first shaft 110, and the second control shaft 1314 is detachably connected to the second shaft 112. This allows for the easy connection and disconnection of the rotary manual control box 1300 to and from the PTCD 100. Easy connection and disconnection may be particularly beneficial for certain applications, such as if the PTCD 100 will remain unattended in a particular location for a period of time. In this case, the rotary manual control box 1300 can easily be removed from the PTCD 100 such that the first plurality of blades 202 and the second plurality of blades 204 remain fixed in a particular, predefined position. Although this preferred embodiment of the PTCD 100 uses a rotary manual control box 1300 as the means for controlling the rotation of the first shaft 110 and the second shaft 110, other suitable control means may also be used. For example, control means using electrical, pneumatic, or hydraulic energy may also be used.

The PTCD 100 is also modular in that one PTCD 100 may be detachably connected to one or more other PTCDs 100. In this preferred embodiment, the first end 140 of the housing 306 is screwed to the second end 146 of the housing 306 of a second PTCD 100. Likewise, the first shaft 110 for the first PTCD 100 is connected to the first shaft 110, and the second shaft 112 of the first PTCD 100 is connected to the second shaft 112, of the second PTCD 100 using a coupler 1402 and a conventional lock-tight screw. In particular, as shown on FIG. 8A, the first shaft 110 in this embodiment has a flat end 804 with a hole passing through, and the second shaft 112 in this embodiment also has a flat end 802 with a hole passing through. Thus, the flat ends 804 of the two first shafts 110 that are to be joined are inserted into opposite sides of the coupler 1402 shown in FIG. 14A,B. A lock-tight screw is used in each of the openings 1406, 1408 in the coupler 1402 to secure the flat ends 804 of the two first shafts 110 to the coupler 1402 by passing through the hole in the flat ends 804 of the first shaft 110. Similar means of attachment may alternatively be used to connect PTCDs 100 to one another. Once connected, a control means as described above can be used to rotate all of the first shafts 110 and all of the second shafts 112 of the connected PTCDs 100.

In addition, the rotary manual control box 1300 described above is detachably connected to a PTCD 100 by the same means using a coupler 1402 and a lock-tight screw. Specifically, the first control shaft 1312 has a flat end 802, 804 which is detachably connected to the flat end 804 of the first shaft 110 with the coupler 1402 and lock-tight screw, and the second control shaft 1314 has a flat end 802, 804 which is detachably connected to the flat end 802 of the second shaft 112 also with a coupler 1402 and lock-tight screw. This allows for the easy connection and disconnection of the rotary manual control box 1300.

The present invention uses a portable and modular base 102 to allow the PTCD 100 to be set up at various desired locations and in various desired configurations. In one of many alternative embodiments of the invention, the base 102 has a length of between about fifteen inches to about twenty-five inches, with a most preferred length of between about eighteen inches to about twenty-two inches. The base 102 has a width of about eight inches to about sixteen inches, with a most preferred width of about ten inches to about fourteen inches. The base 102 is adapted for receiving one or more carrier bearing bases and one or more shafts.

One or more pairs of blades are connected to the first and second shafts along their lengths. In a preferred embodiment, a first blade of the pair is connected to the first shaft and a second blade of the pair is connected to the second shaft. The first blade of each pair is connected facing a first direction, i.e., the tires of traffic approaching the first blade from the first direction ("wrong direction") will be punctured upon encountering the first blade whereas the tires of traffic approaching the first blade from a second direction ("right direction") will not be punctured. The second blade of each pair is connected facing the second direction, i.e., the tires of traffic approaching the second blade from the second direction ("wrong direction") will be punctured upon encountering the second blade whereas the tires of traffic approaching the second blade from the first direction ("right direction") will not be punctured. Each shaft can be rotated independently of the other. As a result, a user can regulate the flow of traffic from either direction using only one traffic control device simply by activating the proper shaft of blades and de-activating the other. A plurality of bases can be connected by connecting the ends of the shafts. A series of blades from adjacent units can be activated or de-activated by rotating an end shaft of the series of connected shafts.

CONCLUSION

While various embodiments of the present invention have been described above, it should be understood that they have been presented by way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined only in accordance with the following claims and their equivalents.

What is claimed is:

1. A portable traffic control device, comprising:

a housing comprising a length extending from a first end to a second end, a width extending from a first side to a second side, a height extending from a bottom to a top, and a plurality of openings on said top of said housing;

a first shaft rotatably connected to said housing and extending from about said first end to about said second end;

a second shaft rotatably connected to said housing and extending generally parallel to said first shaft from about said first end to about said second end;

a first plurality of blades connected to said first shaft, wherein each blade of said first plurality of blades has a first position extending generally upward through an opening of said plurality of openings in said housing and a second position extending generally horizontally within said housing;

a second plurality of blades connected to said second shaft, wherein each blade of said second plurality of blades has a primary position extending generally upward through an opening of said plurality of openings in said housing and a secondary position extending generally horizontally within said housing;

biasing means for urging each blade of said first plurality of blades to rotate toward said first position and each blade of said second plurality of blades to rotate toward said primary position; and a rotating means for rotating said first shaft such that each blade of said first plurality of blades moves between said first position and said second position, and for independently rotating said second shaft such that each blade of said second plurality of blades moves between said primary position and said secondary position.

2. The portable traffic control device of claim 1, wherein said housing further comprises:

a base extending from said first end to said second end and extending from said first side to said second side, said base comprising a generally flat rectangular foundation, side pieces extending upward from said foundation along said first side and said second side, and end pieces extending upward from said foundation along said first end and said second end; and a cover defining said top of said housing, wherein said cover attaches to said base, and wherein said plurality of openings penetrate said cover.

3. The portable traffic control device of claim 2, wherein said cover attaches to said side pieces of said base.

4. The portable traffic control device of claim 2, wherein said housing further comprises:

a plurality of reinforcing channels attached to said foundation, wherein each reinforcing channel has guiding recesses that receive said first shaft and said second shaft; and a plurality of bushing clamps attached to said reinforcing channels, wherein each bushing clamp has recesses aligned with said guiding recesses, and wherein said guiding recesses and said recesses form channels through which said first shaft and said second shaft extend.

5. The portable traffic control device of claim 1, wherein in said first position each blade of said first plurality of blades extends generally upward from said first shaft toward said first side at an angle of about fifty degrees from said bottom of said housing, and wherein in said primary position each blade of said second plurality of blades extends generally upward from said second shaft toward said second side at an angle of about fifty degrees from said bottom of said housing.

6. The portable traffic control device of claim 1, wherein said rotating means is a rotary manual control box comprising:

a control box housing;

a first control shaft rotatably connected to said control box housing, wherein said first control shaft is connected to said first shaft such that rotation of said first control shaft results in a corresponding rotation of said first shaft;

a second control shaft rotatably connected to said control box housing, wherein said second control shaft is connected to said second shaft such that rotation of said second control shaft results in a corresponding rotation of said second shaft;

a first lever arm connected to said first control shaft; and a second lever arm connected to said second control shaft.

7. The portable traffic control device of claim 6, wherein said first control shaft is detachably connected to said first shaft, and wherein said second control shaft is detachably connected to said second shaft.

8. The portable traffic control device of claim 1, wherein said housing, said first shaft, and said second shaft are detachably connectable to an other portable traffic control device of claim 6.

9. The portable traffic control device of claim 8, wherein said first end of said housing is screwed to said second end of said housing of said other portable traffic control device, and wherein said first shaft is connected to said first shaft of said other portable traffic control device using a coupler and a lock-tight screw, and wherein said second shaft is connected to said second shaft of said other portable traffic control device using a coupler and a lock-tight screw.

10. A method for using a portable traffic control device, the method comprising the steps of:

(a) placing a portable traffic control device across a surface traversed by wheeled vehicles, wherein said portable traffic control device comprises:

a housing comprising a length extending from a first end to a second end, a width extending from a first side to a second side, a height extending from a bottom to a top, and a plurality of openings on said top of said housing;

a first shaft rotatably connected to said housing and extending from about said first end to about said second end;

a second shaft rotatably connected to said housing and extending generally parallel to said first shaft from about said first end to about said second end;

a first plurality of blades connected to said first shaft, wherein each blade of said first plurality of blades has a first position extending generally upward through an opening of said plurality of openings in said housing and a second position extending generally horizontally within said housing;

a second plurality of blades connected to said second shaft, wherein each blade of said second plurality of blades has a primary position extending generally upward through an opening of said plurality of openings in said housing and a secondary position extending generally horizontally within said housing; and biasing means for urging each blade of said first plurality of blades to rotate toward said first position and each blade of said second plurality of blades to rotate toward said primary position;

a rotating means for rotating said first shaft such that each blade of said first plurality of blades moves between said first position and said second position, and for independently rotating said second shaft such that each blade of said second plurality of blades moves between said primary position and said secondary position;

(b) rotating said first shaft such that said first plurality of blades is in said first position; and (c) locking said first plurality of blades in said first position.

11. The method of claim 10, further comprising the step of:

(d) rotating said second shaft such that said second plurality of blades is in said first position; and (e) locking said second plurality of blades in said first position.

12. The method of claim 10, further comprising the step of:

(d) securing said portable traffic control device to the surface before performing said steps (b) and (c).

13. The method of claim 10, further comprising the step of:

(d) connecting a second portable traffic control device to said portable traffic control device before performing said step (b), such that a first shaft of said second portable traffic control device is in communication with said first shaft of said portable traffic control device and a second shaft of said second portable traffic control device is in communication with said second shaft of said portable traffic control device.

14. The method of claim 10, further comprising the step of:

(d) unlocking said first plurality of blades from said first position; and (e) rotating said first shaft such that said first plurality of blades is in said second position.

15. The portable traffic control device of claim 1, further comprising drainage means for draining water and debris from said housing.

16. The portable traffic control device of claim 15, wherein said drainage means comprises one or more holes in said housing.

17. The portable traffic control device of claim 1, wherein said biasing means comprises at least one torsion spring.

18. The portable traffic control device of claim 6, wherein said rotary manual control box further comprises a means for locking in position said first level arm and said second lever arm.

19. The portable traffic control device of claim 18, wherein said means for locking comprises:

a first locking arm in communication with said first lever arm; and a second locking arm in communication with said second lever arm.

20. The portable traffic control device of claim 1, further comprising a first means for locking said first plurality of blades in said first position and a second means for locking said second plurality of blades in said second position.

* * * * *